United States Patent [19]

Wirges

[11] 4,257,582

[45] Mar. 24, 1981

[54] SUPPORT COLUMN OF ADJUSTABLE LENGTH

[75] Inventor: Winfried Wirges, Koblenz-Moselweiss, Fed. Rep. of Germany

[73] Assignee: Stabilus GmbH, Koblenz-Neuendorf, Fed. Rep. of Germany

[21] Appl. No.: 641,555

[22] Filed: Dec. 17, 1975

[30] Foreign Application Priority Data

Dec. 16, 1974 [DE] Fed. Rep. of Germany ..... 2459340

[51] Int. Cl.[2] ..... F16M 11/00

[52] U.S. Cl. ..... 267/120; 267/65 D; 248/406; 297/345; 188/300

[58] Field of Search ..... 267/131, 133, 132, 117, 267/120, 65 R, 65 D; 248/399, 400, 401, 404, 405, 406, 407, 408, 409, 410, 411; 297/345, 347; 188/285, 300; 296/65 R; 108/144

[56] References Cited

U.S. PATENT DOCUMENTS

| | | | |
|---|---|---|---|
| 3,711,054 | 1/1973 | Bauer | 297/345 |
| 3,790,119 | 2/1974 | Bauer | 248/400 |
| 3,828,651 | 8/1974 | Dorner et al. | 188/300 |

FOREIGN PATENT DOCUMENTS 2414105 10/1975 Fed. Rep. of Germany .

*Primary Examiner*—James B. Marbert

*Attorney, Agent, or Firm*—Brumbaugh, Graves, Donohue & Raymond

[57] ABSTRACT

A pneumatic spring of the piston-and-cylinder type constitutes a support column whose length may be adjusted when a valve connects the two cylinder compartments on opposite sides of the piston. The valve is normally closed by gas pressure and may be opened by a releasing rod coaxially movable in the bore of a tubular column member. An operating lever for the releasing rod passes radially through an opening in the tubular member and is coupled to the releasing rod during assembly of the apparatus by a cam face on the radially moving lever displacing the rod against the gas pressure in the cylinder, whereupon the rod drops into an axially open recess of the lever from which it can no longer be released because of the limited clearance in the column opening.

9 Claims, 4 Drawing Figures

SUPPORT COLUMN OF ADJUSTABLE LENGTH

BACKGROUND

1. Field of the Invention

The invention relates to columns of adjustable length, such as pneumatic springs of the piston-and-cylinder type, and more particularly to a column having an improved release mechanism for releasing two column members from a locked condition in which the length of the column is fixed or only variable within narrow limits.

While the invention will be described with reference to a pneumatic spring modified to constitute a support column, and such columns provide a preferred field of application for the invention at this time, it will presently become apparent that the invention is not limited to specific features of such a pneumatic spring nor to the exact nature of the column except as will be set forth hereinbelow.

2. The Prior Art

Pneumatic springs of the piston-and-cylinder type are being used widely as single legs for stools and other pieces of furniture. The piston rod may be mounted upright on a base, and a seat assembly on the cylinder, or vice versa. As long as the piston in the cylinder prevents fluid flow between the two compartments of the cylinder cavity which are separated by the piston, the height of the seat is fixed except for minor displacement permitted by resilient compression and expansion of the gas in the cylinder. When the height of the seat is to be changed, a valve connecting the compartments is opened.

For reasons of appearance and others, it is convenient to open the valve by means of a releasing rod coaxially movable in a tubular column member or element, and to move the releasing rod by means of an operating lever pivotally coupled to the releasing rod and projecting from a radial opening of the column member. Because the projecting end of the operating lever interferes with the assembly of the piece of furniture, it is usual preferred practice to insert the operating lever in the otherwise finished stool. For this reason, a known tubular column member may be of axially split construction to provide access to the radial opening for the operating lever, the two parts of the column member being joined after insertion of the operating lever. In another conventional arrangement, the radial opening is made large enough to permit free maneuvering of the lever during insertion. The first-mentioned expedient is relatively costly, and the second one makes for unsatisfactory appearance.

SUMMARY

It is a specific object of this invention to permit convenient installation of an operating lever in an otherwise completely assembled stool or other piece of furniture of the type described without abandoning the advantages of a unitary column member formed with a radial opening barely large enough to permit the normal movement of the lever.

With this object and others in view, as will presently become apparent, the invention, in its basic aspects, provides a column of adjustable length in which two longitudinal column elements are interengaged for relative longitudinal movement, one member having a longitudinal axis and being formed with an axial bore and a radial opening communication with the bore. A locking arrangement normally locks the elements to each other for preventing their longitudinal movement and may be released by a releasing device which includes a releasing member movable in the bore of the one column member between first and second axial positions. Movement of the releasing member from the first to the second axial position causes the locking arrangement to permit relative movement of the column elements. The releasing member is yieldably biased toward its first axial position. An operating member passes through the radial opening in the tubular column member and has respective portions inside and outside the bore of the member. Cooperating coupling devices on the operating member and the releasing member respond to movement of the operating member radially inward of the opening into abutting engagement with the releasing member for coupling the releasing member to the operating member, whereby the releasing member may be moved toward its second position by the coupled operating member.

BRIEF DESCRIPTION OF THE DRAWINGS

Other features, additional objects, and many of the attendant advantages of this invention will readily be appreciated as the same becomes better understood from the following detailed description of preferred embodiments when considered in connection with the appended drawing in which.

DETAILED DESCRIPTION

Figure 1:
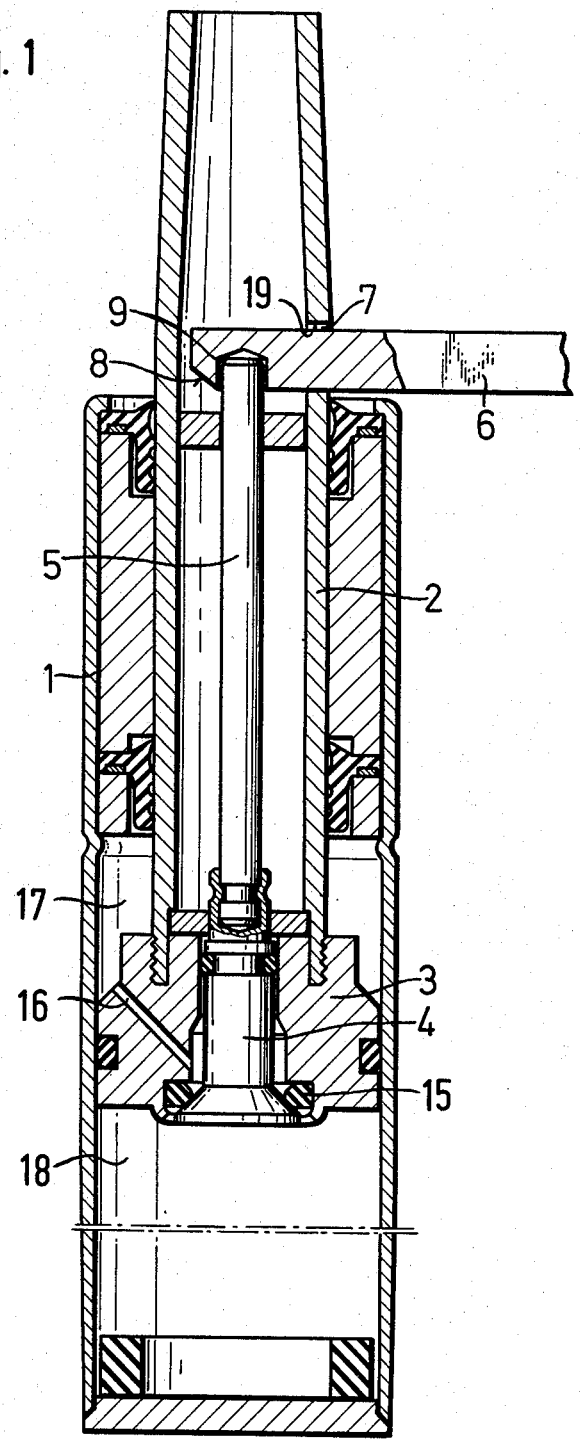
FIG. 1 shows a support column of adjustable height according to the invention in side elevational section on its axis.

Referring initially to FIG. 1, there is seen the single leg of a stool, not shown otherwise, whose base is a downwardly closed cylinder 1. A cylindrical portion of a tubular piston rod 2 is movably sealed into the annular, upper end wall of the cylinder 1. It carries a threadedly mounted piston 3 axially dividing the cylinder cavity into two compartments 17, 18 which are filled with compressed air or nitrogen. A conically tapering free end portion of the piston rod 2 outside the cylinder 1 normally engages a matingly shaped receptacle on the seat assembly of the stool. The weight of a person on the seat causes minor compression of the gas in the compartment 18, but the axial position of the piston 3 is not capable of significant change as long as a valve 4 seals a conduit 16 in the piston 3 by engagement with a valve seat which is an O-ring 15. Displacement of the valve 4 inward of the compartment 18 against the restraint of the compressed gas in the compartment permits flow of gas between the compartments for lengthening or shortening the column. The valve 4 may be opened by axially moving a valve releasing rod 5 coaxially guided in the tubular piston rod 2.

The structure described so far is conventional, and its mode of operation is well understood.

A radial opening 7 in the unitary, tubular piston rod 2 receives an operating lever 6 with very little clearance in an axial direction, and even smaller clearance at right angles to the plane of the drawing. The lever 6, as far as shown, is a flat steet bar. A blind bore 9 in the portion of the lever 6 inside the bore of the piston rod 2 is open in only one direction which is axially downward in FIG. 1, and the free top end of the valve releasing rod 5 is received in the bore 9. When the arm of the lever 6 outside the piston 2 is moved upward, the edge face 19 of the opening 7 provides a fulcrum which causes downward movement of the lever arm inside the piston rod bore, and opening of the valve 4. The axial clearance of the lever 6 in the opening 7 is so small that abutting engagement of the lever 6 with the edge face 19 of the piston rod 2 in the opening 7 limits pivotal lever movement to an angle sufficient to move the valve 4 into its open position. The non-illustrated transverse or circumferential clearance is only sufficient to permit movement of the lever 6 in an axial plane.

Yet, the operating lever 6 is conveniently installed in the otherwise assembled stool without the use of tools. A cam face 8 on the longitudinal front end of the lever 6 is oblique at an angle of about 45° to the direction of lever elongation, and at the same angle to the axis of the column while the lever is being inserted radially through the opening 7. The cam face engages the top of the rod 5 and pushes the rod downward, as viewed in FIG. 1, against the restraint of the gas in the cylinder 1 until the rod 5 drops into the bore 9 during continued radially inward movement of the lever 6 which is thereby brought to a halt. While the lever 6 may thus be installed in its operative condition in a very simple manner, it is secured against accidental removal as long as the biasing pressure of the gas in the cylinder 1 prevails.

Figure 2:
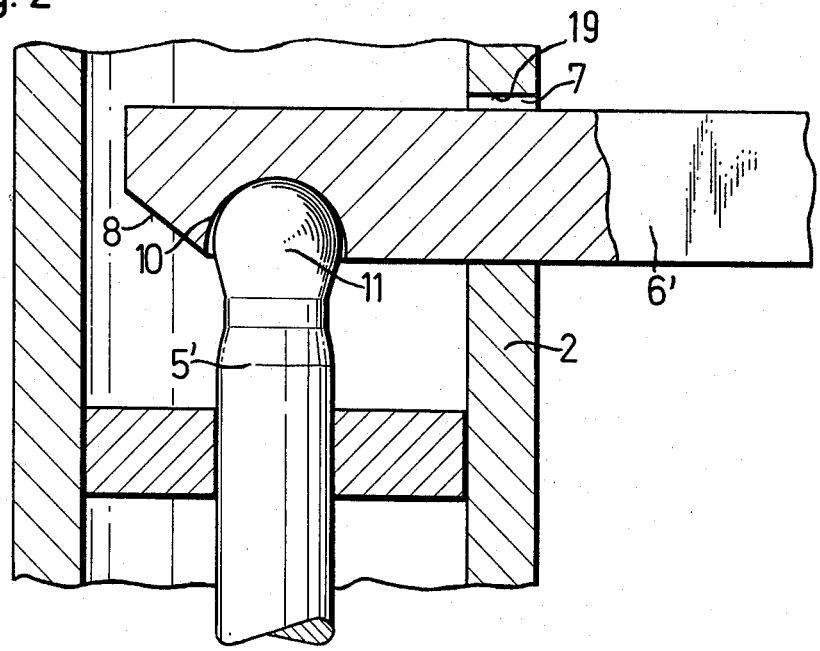
FIGS. 2 and 3 illustrate modifications of the apparatus of FIG. 1 in fragmentary corresponding views on a larger scale.
Figure 3:
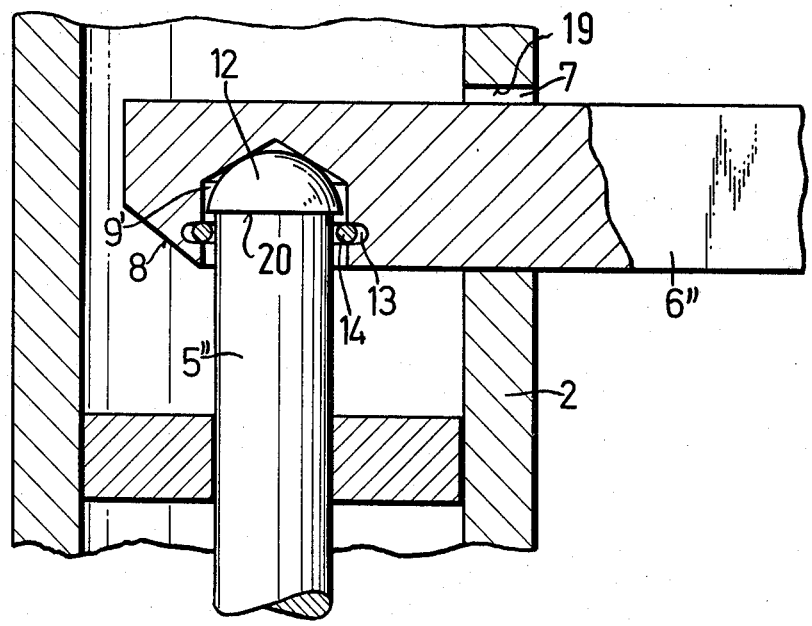

The very simple elements of a snap coupling on the rod 5 and the lever 6, which respond to movement of the lever radially inward of the opening 7 into abutting engagement with the releasing rod 5 for coupling the rod to the lever, may be replaced by more elaborate devices as is shown, by way of example, in FIGS. 2 and 3. The columns partly illustrated in these figures are identical with the one shown in FIG. 1 except as specifically illustrated and described. The releasing rod 5' seen in FIG. 2 has an axially terminal portion 11 which is spherically arcuate and cooperates with a recess 10 of approximately hemispherical, concave shape. The arrangement illustrated in FIG. 2 may be preferred in a column whose length needs to be changed frequently so that wear of the coupling elements may limit the useful life of the column.

If the stroke of the associated valve is very short, the coupling arrangement illustrated in FIG. 3 is advantageous. The releasing rod 5'' carries an integral or otherwise fixedly fastened, hemi-spherical cap 12 whose diameter is somewhat greater than that of the cylindrical rod 5'', so that a downwardly directed, annular face 20 of the cap 12 projects beyond the rod 5''. An annular groove 13 coaxial with the bore 9' communicates with the bore and secures a spring clip 14 which, in its relaxed condition, extends into the bore 9'. During assembly of the coupling shown in FIG. 3, the cam face 8 of the lever 6'' cammingly cooperates with the cap 12 to shift the rod 5'' downward. The cap 12 enters the bore 9' and expands the clip 14 inward of the groove 13 until the face 20 clears the clip which then assumes the illustrated position in which it further secures the lever 6'' to the rod 5''.

Figure 4:
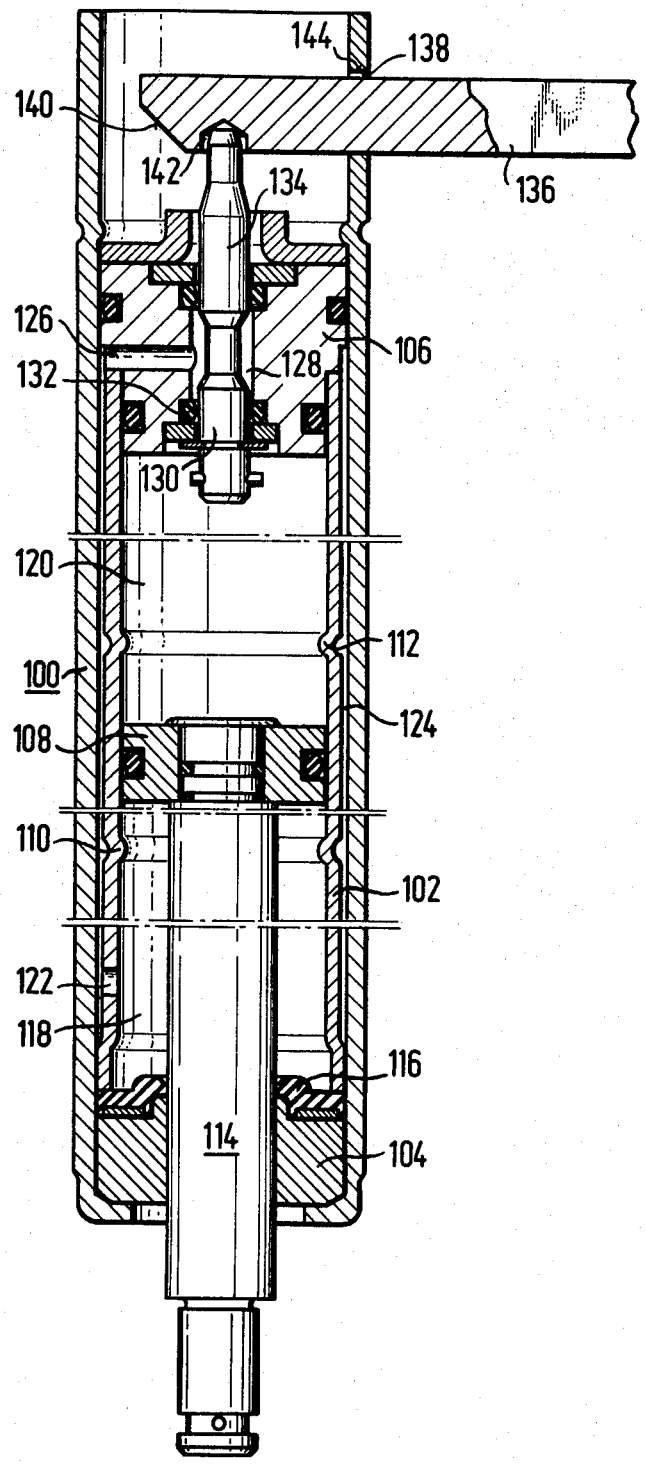
FIG. 4 is a side-elevational sectional view of another column according to this invention.

FIG. 4 illustrates the application of the invention to a support column which is a pneumatic spring of a type different from that seen in FIG. 1.

The column has a generally cylindrical casing 100 in which a cylinder 102 is coaxially mounted between annular, radial walls 104, 106. A piston 108 is axially movable in the cylinder 102 in sealing engagement with the inner cylinder face between axially terminal positions defined by integral, annular ribs 110, 112 of the cylinder 102. The piston is fastened to a piston rod 114 which passes outward of the cylinder 102 in a downward direction through the radial wall 104 to which it is sealed by a packing 116. The piston rod 114 is mounted on a base, and the top portion of the casing 100 is fastened to a seat assembly when the illustrated column is used as the leg of a stool.

The piston 108 axially separates two compartments 118, 120 in the cavity of the cylinder 102, and more than minimal changes in the length of the illustrated column can be brought about only by permitting fluid flow between the compartments. For this purpose, a radial bore 122 in the cylinder 102 communicates with the compartment 118 in all axial positions of the piston 108 and leads into an annular chamber 124 radially bounded by the casing 100 and the cylinder 102. A radial duct 126 leads from the chamber 124 into an axial bore 128 in the heavy, radial wall 106. A valve 130 sealingly engages an O-ring 132 at the lower orifice of the bore 128 toward the compartment 120, and is held in its illustrated position by the pressure of a gas which fills the cylinder 102, the chamber 124, and associated passages. A round releasing bar 134 is attached to the valve 130 and passes axially outward or upward through the wall 106.

An operating bar 136 passes radially inward of the axial bore of the tubular casing 100 through a radial opening 138. Its longitudinal end in the bore has an oblique cam face 140, and a blind bore 142 contiguously adjacent the cam face 140 receives the free top end of the releasing bar 134 to release the valve 130 from its illustrated locking position when the bar 136 is pivoted about the fulcrum provided by an edge face 144 of the casing 100 in the opening 138.

The structure and cooperation of the elements which couple the operating bar 136 to the release bar 134 are almost identical to the corresponding properties of the device shown in FIG. 1, and the very different structure of the pneumatic spring constituting the column members in the apparatus of FIG. 1 is irrelevant to the operation of the coupling. Actually, the coupling of the invention may be used to the same advantage in a column in which liquid-filled compartments may be connected by a valve in a manner otherwise analogous to the showing of the drawing, or even in a column in which two interengaged elongated members are locked to each other by the friction of a spring-loaded cam or in any other manner.

It should be understood, therefore, that the foregoing disclosure relates only to preferred embodiments of the invention and that it is intended to cover all changes and modifications in the examples of the invention herein chosen for the purpose of the disclosure which do not constitute departures from the spirit and scope of the invention set forth in the appended claims.

What is claimed is:

1. A column of adjustable length comprising:

(a) two longitudinal column elements interengaged for relative longitudinal movement, one of said elements having a longitudinal axis and being formed with an axial bore and a radial opening communicating with said bore;

(b) locking means for locking said elements relative to each other and for thereby preventing said movement;

(c) releasing means for releasing said locking means, (1) said releasing means including a releasing member movable in said bore between first and second axial positions, (2) said locking means responding to movement of said releasing member from said first axial position by permitting said relative movement of said column elements;

(d) biasing means yieldably biasing said releasing member toward said first axial position;

(e) an operating member passing through said opening and having respective portions inside and outside said bore;

(f) cooperating coupling means on said members, (1) said coupling means including cam means responsive to movement of said operating member radially inward of said opening into abutting engagement with said releasing member for shifting said releasing member from said first position toward said second position against the restraint of said biasing means, one of said members being formed with a recess open toward the other member, (2) said coupling means further including a portion of said other member received in said recess under the biasing force of said biasing means when said operatng member is moved further inward of said opening after said shifting, (3) said coupling means coupling said members for movement of said releasing member toward said second axial position by manual axial movement of the portion of said operating member outside said bore in the direction away from said second axial position of said releasing member; and (g) means for preventing sufficient axial movement of said portion of said operating member outside said bore in the direction towards said second axial position of said releasing member to permit said portion of said other member received in said recess in said one member from withdrawing from said recess, whereby radially outward movement of the coupled operating member from said opening is prevented.

2. A column as set forth in claim 10, wherein said axial movement limiting means comprises an abutment face in said opening of said one column element providing a fulcrum for pivoting movement of said operating member and limiting the angle of said pivotal movement, said coupling means pivotally connecting said operating member to said releasing member, said releasing member moving from one of said axial positions thereof to the other position during pivotal movement of the coupled operating member through said angle.

3. A column as set forth in claim 2, wherein said one member is said operating member.

4. A column as set forth in claim 3, wherein said cam means on said operating member include a cam face obliquely inclined relative to said axis.

5. A column as set forth in claim 4, wherein said operating member has a spherically concave face in said recess, said releasing member having a spherically convex end face engaging said concave face when said operating and releasing members are coupled.

6. A column as set forth in claim 4, wherein said recess is a blind bore in said operating member.

7. A column as set forth in claim 3, wherein said operating member carries a resilient latch member extending into said recess when in the relaxed condition, said operating member having a radially extending portion deflecting said latch member outward of said recess while said releasing member is being received in said recess, said latch member being located in the path of said radially extending portion and preventing movement of the received releasing member outward of said recess after said receiving.

8. A column as set forth in claim 1, wherein said column elements constitute the piston assembly and the cylinder of a pneumatic spring, said assembly including a piston member received in said cylinder and dividing the interior of said cylinder into two compartments, said biasing means including a body of gas in at least one of said compartments, said locking means including valve means operatively interposed between said compartments for alternatively permitting and preventing fluid flow between said compartments, and said releasing member is operatively connected to said valve means.

9. A column as set forth in claim 1, wherein a portion of said one column element is a unitary body formed with said opening and extending in a closed loop about said opening.

* * * * *

UNITED STATES PATENT AND TRADEMARK OFFICE

CERTIFICATE OF CORRECTION

PATENT NO. : 4,257,582
DATED : March 24, 1981
INVENTOR(S) : Winfried Wirges

It is certified that error appears in the above—identified patent and that said Letters Patent is hereby corrected as shown below:

Column 1, line 66, "member" should read --element--;

Column 2, line 5, "member" should read --element--;

Column 2, line 11, "member" should read --element--;

Column 2, line 13, "member" should read --element--:

Column 3, line 5, after "piston" insert --rod--; and

Column 6, line 1, "claim 10" should read --claim 1--.

Signed and Sealed this

*Seventh* Day of *July 1981*

[SEAL]

*Attest:*

RENE D. TEGTMEYER

*Attesting Officer*

*Acting Commissioner of Patents and Trademarks*